US010440788B2

(12) United States Patent
Mercier et al.

(10) Patent No.: US 10,440,788 B2
(45) Date of Patent: Oct. 8, 2019

(54) OPTOELECTRONIC CIRCUIT COMPRISING LIGHT EMITTING DIODES

(71) Applicant: Aledia, Grenoble (FR)

(72) Inventors: Frédéric Mercier, Saint Nicolas de Macherin (FR); Xavier Hugon, Teche (FR); Philippe Gilet, Teche (FR)

(73) Assignee: Aledia, Grenoble (FR)

( * ) Notice: Subject to any disclaimer, the term of this patent is extended or adjusted under 35 U.S.C. 154(b) by 0 days.

(21) Appl. No.: 16/066,632

(22) PCT Filed: Dec. 29, 2016

(86) PCT No.: PCT/FR2016/053682

§ 371 (c)(1),
(2) Date: Jun. 27, 2018

(87) PCT Pub. No.: WO2017/115055

PCT Pub. Date: Jul. 6, 2017

(65) Prior Publication Data

US 2019/0014627 A1 Jan. 10, 2019

(30) Foreign Application Priority Data

Dec. 31, 2015 (FR) ..... 15 63488

(51) Int. Cl.
*H05B 37/00* (2006.01)
*H05B 33/08* (2006.01)
*H05B 37/02* (2006.01)

(52) U.S. Cl.
CPC ..... *H05B 33/083* (2013.01); *H05B 33/0845* (2013.01); *H05B 37/0245* (2013.01)

(58) Field of Classification Search
CPC .... H05B 41/34; H05B 33/0803; H05B 39/09; H05B 41/28; H05B 33/0809;
(Continued)

(56) References Cited

U.S. PATENT DOCUMENTS 5,278,432 A * 1/1994 Ignatius ..... H01L 25/0753 257/723
2002/0039721 A1* 4/2002 Hull ..... F41A 33/02 434/22
(Continued)

FOREIGN PATENT DOCUMENTS

CN 103458562 A 12/2013
DE 10 2010 034347 A1 2/2012
(Continued)

OTHER PUBLICATIONS

International Search Report for Application No. PCT/FR2016/053682 dated Mar. 20, 2017.
(Continued)

*Primary Examiner* — Minh D A
(74) *Attorney, Agent, or Firm* — Wolf, Greenfield & Sacks, P.C.

(57) ABSTRACT

An optoelectronic circuit including separate interconnected basic electronic circuits, each of which includes at least one light emitting diode and at least one integrated circuit chip that has a circuit for controlling the light emitting diode, the circuit being suitable for activating or deactivating the light emitting diode.

16 Claims, 7 Drawing Sheets

(58) Field of Classification Search
CPC ..... H05B 41/295; H05B 41/2827; H05B 41/3925; H05B 33/0815; H05B 33/0818; H05B 41/2828; H05B 41/3921; H05B 41/3927; H05B 37/029; H05B 37/0254; H05B 37/02; Y02B 20/202
See application file for complete search history.

(56) References Cited

U.S. PATENT DOCUMENTS

| | | | | |
|---|---|---|---|---|
| 2008/0258695 | A1 | 10/2008 | Kumar et al. | |
| 2009/0128056 | A1* | 5/2009 | Lin ..... | H05B 33/0818 315/301 |
| 2009/0284184 | A1 | 11/2009 | Valois et al. | |

FOREIGN PATENT DOCUMENTS

| | | | |
|---|---|---|---|
| EP | 2 088 836 | A1 | 8/2009 |
| WO | WO 2008/001274 | A2 | 1/2008 |
| WO | WO 2015/183570 | A1 | 12/2015 |

OTHER PUBLICATIONS

Written Opinion of the International Searching Authority dated Mar. 20, 2017 in connection with Application No. PCT/FR2016/053682.

* cited by examiner

OPTOELECTRONIC CIRCUIT COMPRISING LIGHT EMITTING DIODES

CROSS-REFERENCE TO RELATED APPLICATIONS

This Application is a national stage filing under 35 U.S.C. 371 of International Patent Application Serial No. PCT/FR2016/053682, filed Dec. 29, 2016, which claims priority to French application number 1563488, filed Dec. 31, 2015. The entire contents of these applications are incorporated herein by reference in their entirety.

BACKGROUND

The present description relates to an optoelectronic circuit, particularly to an optoelectronic circuit comprising light-emitting diodes.

DISCUSSION OF THE RELATED ART

For certain applications, it is known to successively activate sets of light-emitting diodes of an optoelectronic circuit. An example concerns the power supply of an optoelectronic circuit comprising light-emitting diodes with an AC voltage, particularly a sinusoidal voltage, for example, the mains voltage.

FIG. 1 shows an example of an optoelectronic circuit 10 comprising input terminals $IN_1$ and $IN_2$ having an AC voltage $V_{IN}$ applied therebetween. Optoelectronic circuit 10 further comprises a rectifying circuit 12 comprising a diode bridge 14, receiving voltage $V_{IN}$ and supplying a rectified voltage $V_{ALIM}$ which powers N series assemblies of elementary light-emitting diodes, called general light-emitting diodes $D_i$, where i is an integer in the range from 1 to N.

Optoelectronic circuit 10 comprises a current source 22 having a terminal coupled to node $A_2$ and having its other terminal coupled to a node $A_3$. Circuit 10 comprises a device 24 for switching general light-emitting diodes $D_i$, i being in the range from 1 to N. Switching device 24 enables to progressively increase the number of general light-emitting diodes receiving power supply voltage $V_{ALIM}$ during a rising phase of power supply voltage $V_{ALIM}$ and to progressively decrease the number of general light-emitting diodes receiving power supply voltage $V_{ALIM}$ during a falling phase of power supply voltage $V_{ALIM}$. This enables to decrease the time during which no light is emitted by optoelectronic circuit 10. As an example, device 24 comprises N controllable switches $SW_1$ to $SW_N$. Each switch $SW_i$, with i varying from 1 to N, is assembled between node $A_3$ and the cathode of general light-emitting diode $D_i$ and is controlled by a control module 26 according to signals supplied by a sensor 28.

The order in which switches $SW_i$ are turned on and off is set by the structure of optoelectronic circuit 10 and is repeated for each cycle of power supply voltage $V_{ALIM}$.

FIG. 2 is a timing diagram of power supply voltage $V_{ALIM}$ in the case where AC voltage $V_{IN}$ corresponds to a sinusoidal voltage and for an example where optoelectronic circuit 10 comprises four light-emitting diodes $D_1$, $D_2$, $D_3$, and $D_4$. FIG. 2 schematically shows phases $P_1$, $P_2$, $P_3$, and $P_4$. Phase $P_1$ shows the conduction phase of general light-emitting diode $D_1$. Phase $P_2$ shows the conduction phase of general light-emitting diode $D_2$. Phase $P_3$ shows the conduction phase of general light-emitting diode $D_3$. Phase $P_4$ shows the conduction phase of general light-emitting diode $D_4$.

A disadvantage of optoelectronic circuit 10 is that the light emission time is not the same for each general light-emitting diode. Thereby, the lifetime of the general light-emitting diode which emits light the most often may be shorter than the lifetime of the general light-emitting diode which emits light the least often. Further, according to the configuration of optoelectronic circuit 10, an observer may perceive an inhomogeneity of the light power emitted by optoelectronic circuit 10.

FIG. 3 partially and schematically shows a top view of optoelectronic circuit 10 comprising an area 30 having general light-emitting diodes $D_1$ to $D_4$ formed therein and an area 32 having the other elements of the optoelectronic circuit 10 formed therein. As an example, general light-emitting diodes $D_1$ to $D_4$ are substantially aligned and arranged next to one another. In this example of layout, an observer may perceive, in particular when the general light-emitting diodes are spaced apart, light power emitted by area 30 of optoelectronic circuit 10 which is larger on the side of general light-emitting diode $D_1$, which has the longest light emission time, than on the side of general light-emitting diode $D_4$, which has the shorter light emission time.

Solving this disadvantage with a different layout of the light-emitting diodes may turn out being complex. The light-emitting diodes of each group should for this purpose be for example distributed across the entire circuit, which would greatly complicate the connection of the light-emitting diodes to one another and would probably impose the use of a circuit with a plurality of metallization levels.

SUMMARY

An object of an embodiment is to overcome all or part of the disadvantages of the previously-described optoelectronic circuits comprising general light-emitting diodes and a device for switching the light-emitting diodes.

Another object of an embodiment is to improve the homogeneity of light emission by the optoelectronic circuit.

Another object of an embodiment is to increase the lifetime of the general light-emitting diode which emits light for the longest time.

Another object of an embodiment is to decrease the bulk of the optoelectronic circuit.

Another object of an embodiment is for the number of general light-emitting diodes of the optoelectronic circuit to be simply modifiable.

Another object of an embodiment is for the order of activation of the general light-emitting diodes to be simply modifiable.

Thus, an embodiment provides an optoelectronic circuit comprising interconnected separate elementary electronic circuits, each elementary electronic circuit comprising:

at least one light-emitting diode; and at least one integrated circuit chip comprising a circuit for controlling the light-emitting diode capable of activating or of deactivating the light-emitting diode.

According to an embodiment, each elementary electronic circuit comprises in a same package said at least one light-emitting diode and said at least one integrated circuit chip.

According to an embodiment, the integrated circuit chip of each elementary electronic circuit further comprises a switching circuit containing a modulation circuit capable of supplying a first modulated signal and a demodulation circuit capable of supplying a second signal by demodulation of the first signal, the control circuit of the light-emitting diode being capable of activating or of inhibiting the light-emitting diode from the second signal.

According to an embodiment, each elementary electronic circuit comprises a control circuit capable of supplying a signal of activation or of deactivation to the other elementary electronic circuits. The optoelectronic circuit is intended to receive a variable voltage. For each elementary electronic circuit, the circuit for controlling the light-emitting diode is capable of activating or inhibiting the light-emitting diode according to the activation or deactivation signal, whereby the number of activated light-emitting diodes depends on the value of the variable voltage.

According to an embodiment, each elementary electronic circuit comprises a current source coupled to the light-emitting diode.

According to an embodiment, the integrated circuit chip of each elementary electronic circuit further comprises a circuit for detecting a master or slave state of the elementary electronic circuit when the elementary electronic circuit is in operation.

According to an embodiment, the optoelectronic circuit comprises a plurality of series-assembled elementary electronic circuits.

According to an embodiment, at least one of the elementary electronic circuits, called master circuit, is capable of transmitting data to the other elementary electronic circuits, called slave circuits, so that the light-emitting diodes are activated randomly or according to a given succession.

According to an embodiment, each elementary electronic circuit further comprises a first terminal. The optoelectronic circuit comprises a sensor coupled to the first terminal of one of the elementary electronic circuits and the intensity of the current supplied by the current source of the master circuit depends on a third signal supplied by the sensor.

According to an embodiment, the optoelectronic circuit comprises a plurality of elementary electronic circuits assembled in parallel.

According to an embodiment, for each elementary electronic circuit, the first signal corresponds to a modulation of the power supply current of the light-emitting diode.

According to an embodiment, each elementary electronic circuit further comprises a second terminal. The second signal corresponds to a modulated current supplied by the modulation circuit to the second terminal which is different from the power supply current of the light-emitting diode, or the second signal corresponds to the potential at said terminal.

According to an embodiment, the optoelectronic circuit further comprises a third terminal, the demodulation circuit being capable of receiving the second signal via the third terminal.

According to an embodiment, the third terminal of each elementary electronic circuit is coupled to a conductive line via a capacitor.

According to an embodiment, each elementary electronic circuit further comprises a fourth terminal and a copying circuit coupling the third terminal and the fourth terminal and capable of supplying the demodulation circuit with a copy of the current flowing between the third and fourth terminals.

According to an embodiment, the elementary electronic circuits are series-assembled according to a succession of elementary electronic circuits. For each elementary electronic circuit, except for the elementary electronic circuits located at the ends of the succession, the fourth terminal of the elementary electronic circuit is coupled to the third terminal of the previous elementary electronic circuit in the succession.

According to an embodiment, each elementary electronic circuit comprises less than five light-emitting diodes.

BRIEF DESCRIPTION OF THE DRAWINGS

The foregoing and other features and advantages will be discussed in detail in the following non-limiting description of specific embodiments in connection with the accompanying drawings, among which.

DETAILED DESCRIPTION

Figure 1:
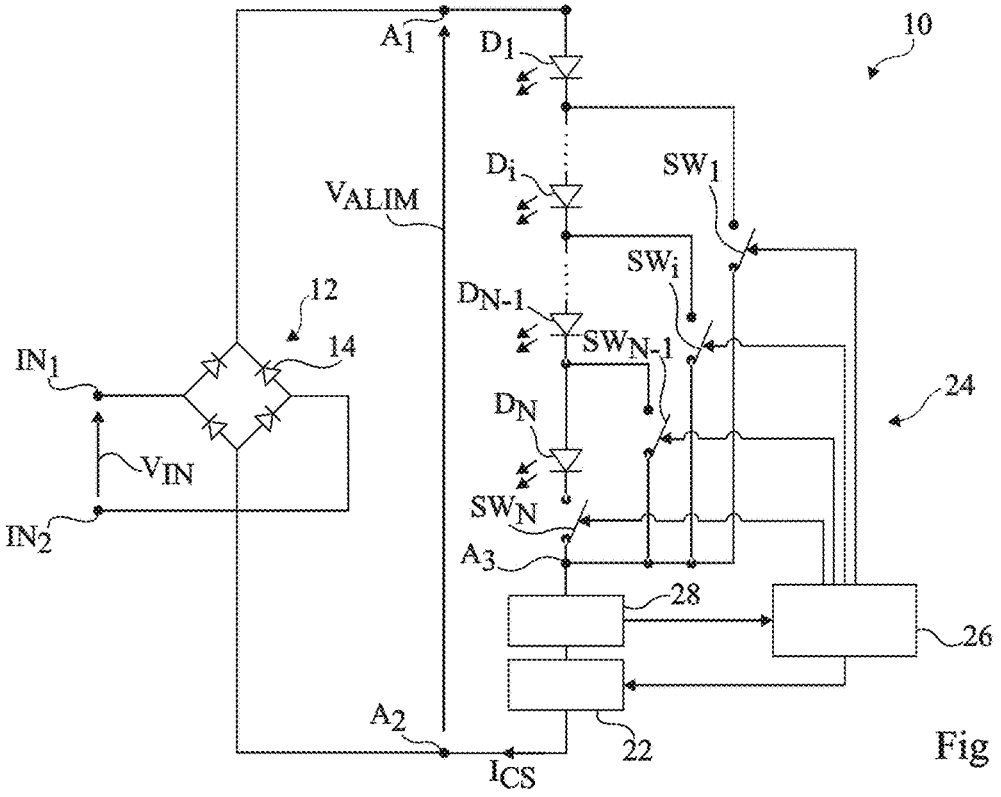
FIG. 1, previously described, is an electric diagram of an example of an optoelectronic circuit comprising light-emitting diodes.
Figure 2:
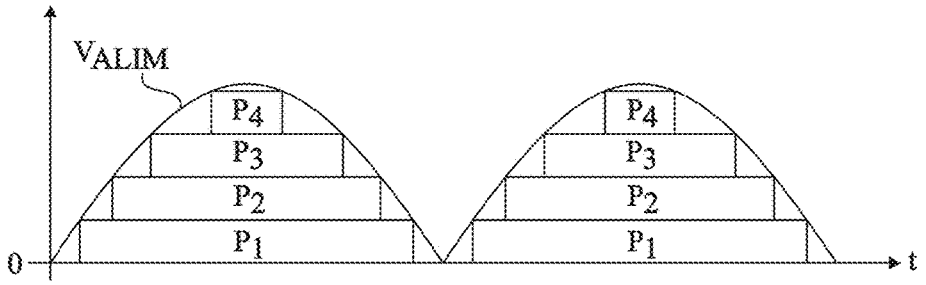
FIG. 2, previously described, is a timing diagram showing the light emission phases of the light-emitting diodes of the optoelectronic circuit of FIG. 1.
Figure 3:
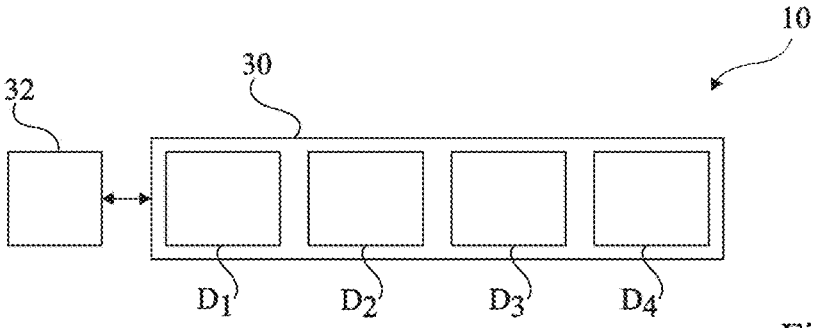
FIG. 3, previously described, is a partial simplified top view of an example of a layout of the elements of the optoelectronic circuit of FIG. 1.

For clarity, the same elements have been designated with the same reference numerals in the various drawings and, further, the various drawings are not to scale. The terms "approximately", "substantially", and "in the order of" are used herein to designate a tolerance of plus or minus 10% of the value in question. Further, a signal which alternates between a first constant state, for example, a low state, noted "0", and a second constant state, for example, a high state, noted "1", is called "binary signal". The high and low states of different binary signals of a same electronic circuit may be different. In particular, the binary signals may correspond to voltages or to currents which may not be perfectly constant in the high or low state. Further, in the present description, term "connected" is used to designate a direct electric connection, with no intermediate electronic component, for example, by means of a conductive track, and term "coupled" or term "linked" will be used to designate either a direct electric connection (then meaning "connected") or a connection via one or a plurality of intermediate components (resistor, capacitor, etc.).

According to an embodiment, the optoelectronic circuit has a modular structure and comprises a plurality of modules, also called elementary electronic circuits, coupled to one another. According to an embodiment, the modules are not connected to a common node coupled to a source of a low reference potential, for example, the ground of the optoelectronic circuit. In particular, for most modules, each module is only coupled to one or to two other modules and has a floating ground. Each module comprises a general light-emitting diode and an electronic circuit. According to an embodiment, the general light-emitting diode corresponds to a first integrated circuit chip and the electronic circuit corresponds to a second integrated circuit chip, the first and second chips being assembled on a printed circuit or integrated in a same package. According to an embodiment, the modules all have the same structure. This advantageously enables to easily add a module to the optoelectronic circuit or to easily remove a module from the optoelectronic circuit.

According to an embodiment, for each module, the electronic circuit comprises a circuit for controlling the general light-emitting diode, for example, a circuit of activation/inhibition of the general light-emitting diode. The electronic circuits of the modules enable to activate or to inhibit the general light-emitting diodes according to the value of the power supply voltage of the optoelectronic circuit according to a selection sequence.

According to an embodiment, the electronic circuits of the modules are capable of communicating with one another, for example, for the transmission of the light-emitting diode selection sequence according to the power supply voltage.

According to an embodiment, the modules may be coupled to one another so that the general light-emitting diodes can be assembled in series and/or in parallel.

Preferably, the number of light-emitting diodes which are activated varies automatically according to the value of the power supply voltage.

Preferably, the sequence of light-emitting diode selection according to the power supply voltage is a random or pseudo-random sequence.

According to an embodiment, the optoelectronic circuit comprises at least one assembly of a plurality of series-assembled modules, the sequence of selection of the general light-emitting diodes of the modules of this assembly is controlled by a single one of the modules of this assembly, called master module, the other modules of the assembly being called slave modules. According to an embodiment, each module is capable of being a master module or a slave module and the configuration of each module as a master module or as a slave module is automatically obtained, for example, by the way in which the module is connected to the other modules in the optoelectronic circuit.

According to an embodiment, each module comprises a current source for powering the light-emitting diode of the module. Preferably, only the current source of the master module is activated.

According to an embodiment, the control circuit is capable of modifying the intensity of the current supplied by the current source, for example, based on a set point value received by the unit.

According to an embodiment, the optoelectronic circuit comprises a plurality of modules emitting lights of different colors, one of the modules being capable of controlling the other modules for the control of the general color emitted by all the modules.

Figure 4:
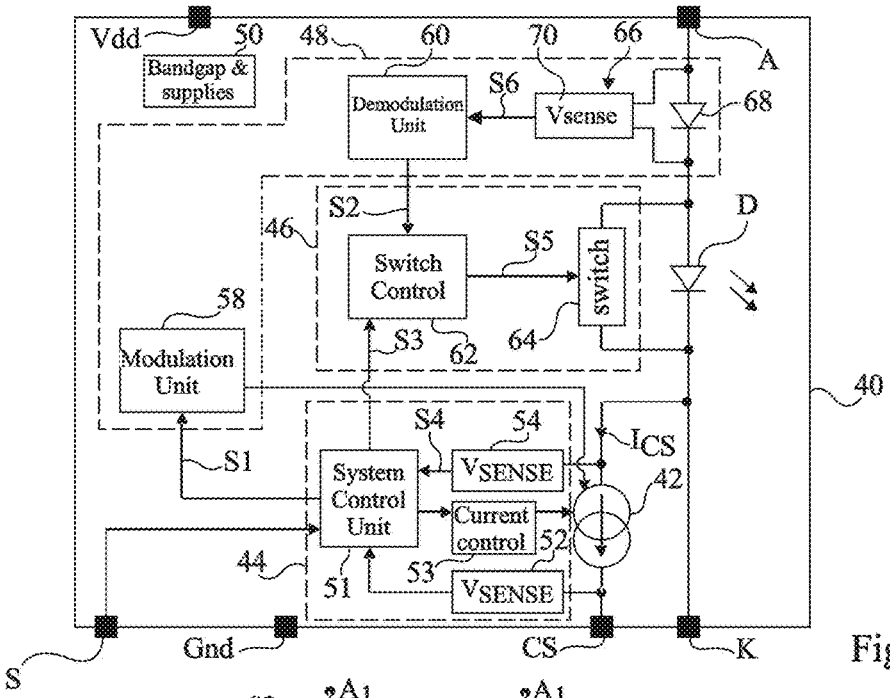
FIG. 4 is an electric diagram of an embodiment of a module of an optoelectronic circuit comprising light-emitting diodes.

FIG. 4 shows an embodiment of a module 40 capable of being used to form an optoelectronic circuit. Module 40 comprises:

terminals A, K, CS, Vdd, S, and Gnd;

a general light-emitting diode D having its cathode coupled to terminal K and having its anode coupled to terminal A;

a current source 42 having a terminal coupled to the cathode of general light-emitting diode D and having its other terminal coupled to terminal CS;

a control circuit 44 capable of supplying a signal 51 of selection of general light-emitting diodes;

a circuit 46 for controlling general light-emitting diode D, receiving a signal S2 and capable of short-circuiting general light-emitting diode D or of making it conductive according to signal S2;

a switching circuit 48 capable of supplying signal S2 from signal 51; and a circuit 50 (Bandgap & supplies) for supplying power supply voltages/currents to the different circuits of module 40.

The circuits of module 40 may totally or partly correspond to dedicated circuits. However, at least some of these circuits may comprise a processor capable of executing a computer program stored in a memory.

Terminal Vdd is intended to be coupled to a source of a high potential and terminal Gnd is intended to be coupled to a source of a low potential. Each module 40 has a local ground since the potentials in a module 40 are referenced to the potential at terminal Gnd of this module 40. The electric connections between circuit 50 and the other circuits of module 40 are not shown. Similarly, the connections between the circuits of module 40 and terminals Vdd and Gnd are not shown. According to another embodiment, each module 40 comprises at least one capacitor which is charged each time general light-emitting diode D is conductive and circuit 50 (Bandgap & supplies) supplies the power supply voltages/currents of the different circuits of module 40 from the energy stored in the capacitor. Terminal Vdd may then be absent.

General light-emitting diode D comprises at least one elementary light-emitting diode and is preferably formed of the series and/or parallel connection of at least two elementary light-emitting diodes.

Each module 40 may correspond to a single integrated circuit chip or may comprise two integrated circuit chips or more than two integrated circuit chips. Each module 40 corresponds to a separate elementary electronic circuit and all the components of module 40 are contained in a same package. In particular, general light-emitting diode D and the integrated circuit chip or the integrated circuit chips comprising circuits 44, 46, 48, and 50 are contained in a same package.

Control circuit 44 comprises a circuit 51 (System Control Unit) for controlling module 40, called selection unit hereafter. Selection unit 51 is capable of selecting the "master" or "slave" state of module 40 and of supplying a signal S3 to control circuit 46 representative of the fact that module 40 operates as a master module or as a slave module. As a variation, there is no transmission of signal S3 between control circuit 44 and control circuit 46. According to an embodiment, selection unit 51 is capable of determining whether current source 42 of module 40 is operating. When current source 42 is operating, selection unit 51 for example supplies a signal S3 at "1", which means that module 40 operates as a master module. When current source 42 is not operating, selection unit 51 for example supplies a signal S3 at "0", which means that module 40 operates as a slave module. According to an embodiment, optoelectronic circuit 10 comprises a voltage sensor 52 (Vsense) coupled to selection unit 51 and capable of measuring the potential at terminal CS.

According to an embodiment, selection unit 51 is capable of controlling intensity $I_{CS}$ of the current supplied by current source 42. As an example, selection unit 51 is capable of supplying an intensity set point of current $I_{CS}$ to a current control circuit 53 (Current Control), which converts the set point into a signal for controlling current source 52.

Each module 40 may further comprise terminal S, which is coupled to selection unit 51. A circuit external to modules 40, for example, a sensor, not shown in FIG. 4, may be coupled to terminal S. As an example, set point $I_{CS}$ supplied by circuit 51 may depend on the signal received by circuit 51 by terminal S.

According to an embodiment, selection unit 51 receives a measurement signal S4 supplied by a sensor 54 (Vsense). As an example, sensor 54 is a voltage sensor capable of measuring the voltage at the cathode of general light-emitting diode D. Selection unit 51 is capable of supplying signal S1, which is representation of the light-emitting diodes of the optoelectronic circuit to be activated/inhibited.

Communication circuit 48 comprises a modulation unit 58 receiving signal S1 supplied by control circuit 44 and a demodulation unit 60 supplying signal S2 to control circuit 46. Modulation unit 58 and demodulation unit 60 implement steps of modulation/demodulation so that signal S2 is, like signal S1, representative of the light-emitting diodes of the optoelectronic circuit to be activated/inhibited.

Control circuit 46 comprises a switch control circuit 62 receiving signal S2 and signal S3 and supplying a control signal S5 to a switch 64 assembled across general light-emitting diode D. As an example, signal S5 is a binary signal and switch 64 is off when signal S5 is in a first state, for example, the low state, and switch 64 is on when signal S5 is in a second state, for example, the high state. Each switch 64 is, for example, a switch comprising at least one transistor, particularly a field-effect metal-oxide gate transistor or enrichment (normally on) or depletion (normally off) MOS transistor. According to an embodiment, each switch 64 comprises a MOS transistor, for example, having an N channel, having its drain coupled to the anode of general light-emitting diode D, having its source coupled to the cathode of general light-emitting diode D, and having its gate receiving signal S5.

In the present embodiment, the modulation/demodulation step implemented by communication circuit 48 comprises modulating current $I_{CS}$ supplied by current source 42. Modulation circuit 58 is then capable of controlling current source 42 to modulate current $I_{CS}$ supplied by current source 42. Communication circuit 48 further comprises a circuit 66 for detecting the modulation of current $I_{CS}$ comprising a diode 68 series-assembled between terminal A and the anode of general light-emitting diode D and a sensor 70 of the voltage across diode 68, supplying a signal S6 to demodulation circuit 60.

Figure 5:
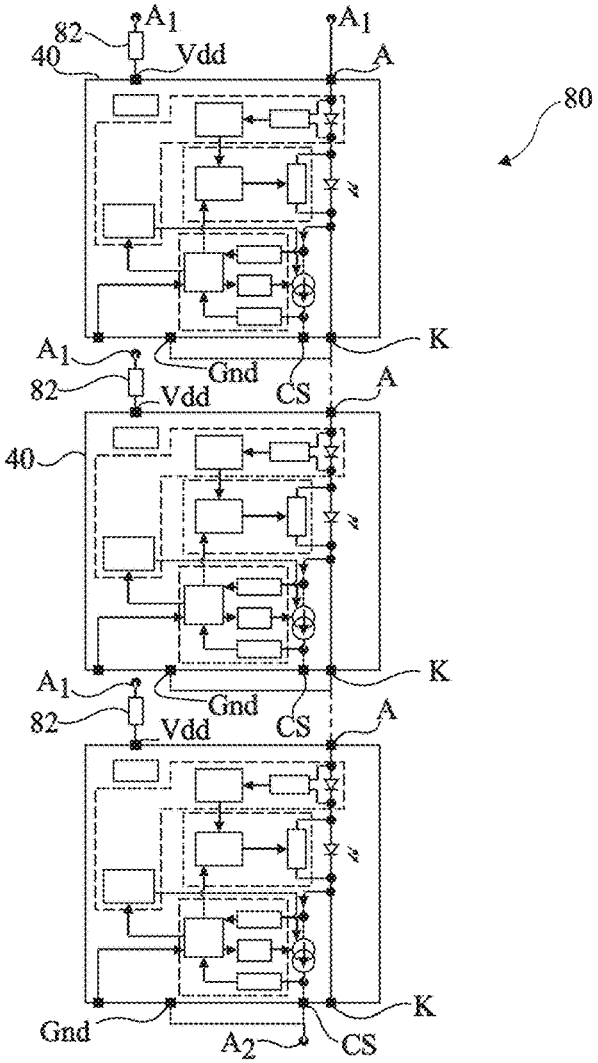
FIG. 5 is an electric diagram of an embodiment of an optoelectronic circuit formed from the module shown in FIG. 4.

FIG. 5 shows an embodiment of an optoelectronic circuit 80 comprising N modules 40 such as shown in FIG. 4, where N is an integer in the range from 2 to 200, three modules 40 being shown as an example in FIG. 5. Modules 40 correspond to separate elementary circuits. In particular, the packages of modules 40 are different. According to an embodiment, optoelectronic circuit 80 comprises a succession of modules 40 series-assembled between a node $A_1$ and a node $A_2$, the module at the first position in the succession being that connected to node $A_1$ and the module at the last position in the succession being that connected to node $A_2$. A power supply voltage $V_{ALIM}$ is applied between nodes $A_1$ and $A_2$. Power supply voltage $V_{ALIM}$ may correspond to the oscillating voltage supplied by a rectifying circuit. As a variation, the power supply voltage may be a DC voltage, for example, a substantially constant voltage.

For each module 40, terminal Vdd is coupled to node $A_1$ by a resistor 82, which may be identical or different according to modules 40. The value of each resistor 82 is selected so that, for each module 40, the potential at terminal Vdd is within a range of values adapted to the proper operation of circuit 50 for the supply of the voltages/currents for powering the components of module 40.

For the master module, the connections of terminals A, K, Gnd, and CS are formed as follows:

terminal K is left floating;

when the master module is connected to node $A_1$, terminal A of the master module is connected to node $A_1$;

when the master module is connected to node $A_2$, terminals CS and Gnd of the master module are connected to node $A_2$;

when the master module is not at an end of the succession of modules 40, terminal A of the master module is connected to terminals K and Gnd of the previous slave module and terminals CS and Gnd of the master module are connected to terminal A of the next slave module.

For each slave module, the connections of terminals A, K, Gnd, and CS are formed as follows:

terminal CS is left floating;

when the slave module is connected to node $A_1$, terminal A of the slave module is connected to node $A_1$;

when the slave module is connected to node $A_2$, terminals K and Gnd of the slave module are connected to node $A_2$;

when the slave module is not at an end of the chain, terminal A of the slave module is connected to terminals K and Gnd of the previous module when the previous module is a slave module or to terminals CS and Gnd of the previous module when the previous module is the master module and terminals K and Gnd of the slave module are connected to terminal A of the next module (slave or master).

Preferably, modules 40 are connected to one another so that there is a single master module, shown as an example in the last position in FIG. 5.

Optoelectronic circuit 80 operates as follows. The selection unit 51 of each module 40 determines whether terminal CS is left floating. If this occurs, selection unit 51 transmits an inhibition signal S3 to control circuit 46 and the considered module operates as a slave module. When terminal CS is detected as not being left floating, selection unit 51 transmits an activation signal S3 to control circuit 46 and the considered module operates as a master module. The detection of the fact that terminal CS is floating or not may be performed by comparing the potential at terminal CS and the potential at terminal Gnd. If the potentials are equal, this means that terminal CS is not floating, and if the potentials are different, this means that terminal CS is left floating.

In operation, the control circuit 44 of the master module controls modulation unit 58 so that it transmits data by modulation of current $I_{CS}$. The modulation of current $I_{CS}$ may be a modulation of any type, for example, an amplitude modulation and/or a frequency modulation. The modulation circuit 58 of each slave module remains inactive. The demodulation unit 60 of each module is capable of receiving the data transmitted by demodulation of current $I_{CS}$ and switch control unit 62 is capable of controlling switch 64 to the off or on state according to the received data.

According to an embodiment, the data supplied by the master module and transmitted to each slave module by modulation of current $I_{CS}$ may be representative of an order of activation of the general light-emitting diodes during the variation of power supply voltage $V_{ALIM}$, for example, during each cycle of voltage $V_{ALIM}$ in the case of a voltage $V_{ALIM}$ which varies periodically. This order of activation may be modified along time so that the order of activation of the general light-emitting diodes is not always the same for each cycle of power supply voltage $V_{ALIM}$. As an example, the order of activation of the general light-emitting diodes may be random.

According to an embodiment, each module has an associated single identifier and the data supplied by the master module particularly comprise a succession of identifiers. The list of identifiers may be stored in a memory of control circuit 46. As an example, when a slave module receives the identifier associated therewith, it switches the state of switch 64, from off to on or from on to off.

Figure 6:
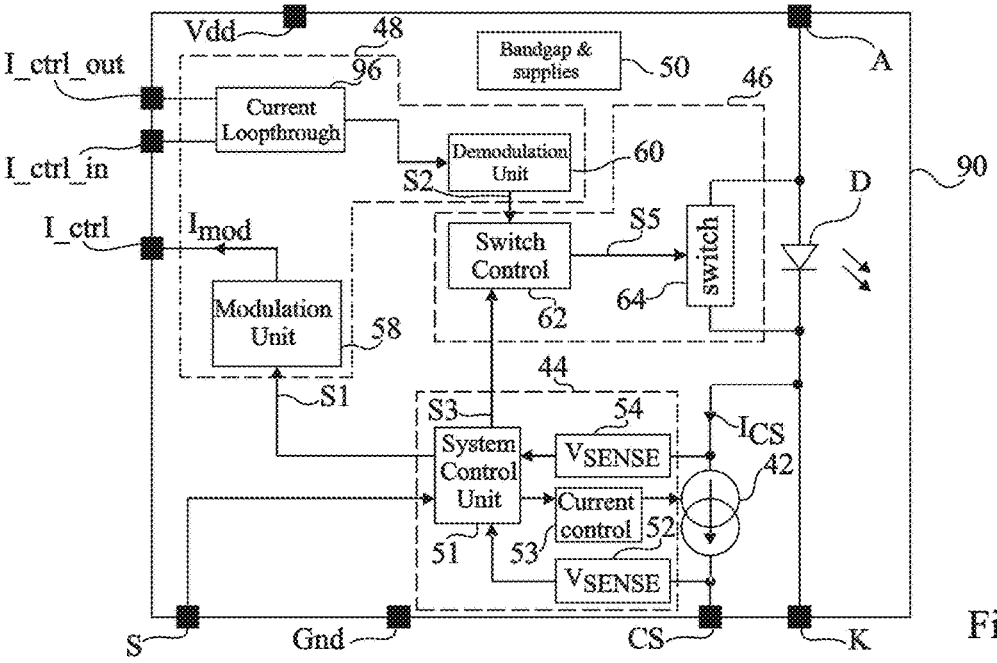
FIGS. 6 and 7 are drawings respectively similar to FIGS. 4 and 5 of another embodiment of a module and of an optoelectronic circuit formed from this module.
Figure 7:
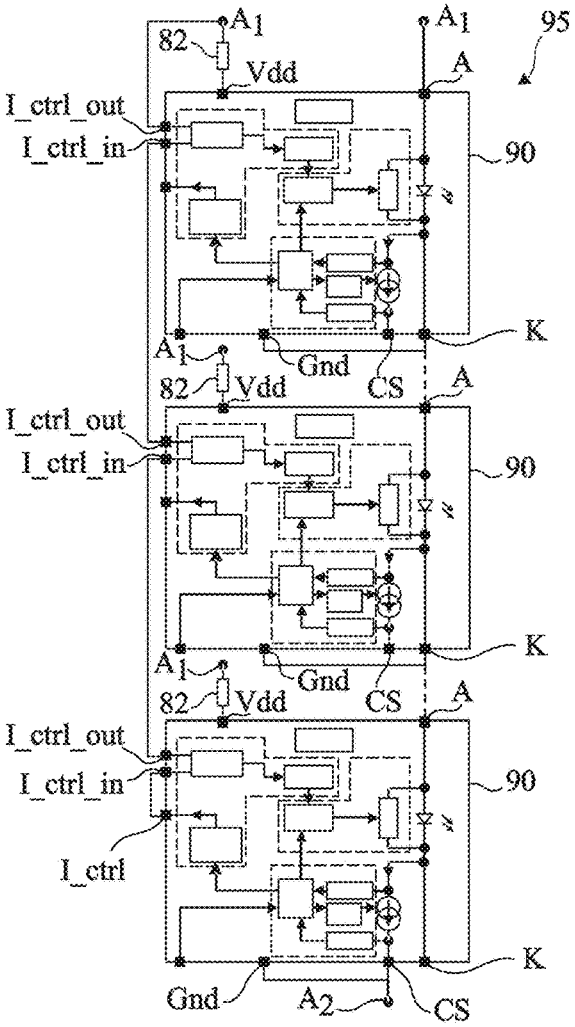

FIGS. 6 and 7 are drawings similar to FIGS. 4 and 5 respectively of another embodiment of a module 90 and of an optoelectronic circuit 95 comprising a plurality of modules 90.

The elements common between module 40 and module 90 are designated with the same references. Module 90 comprises all the elements of module 40, with the difference that there is no modulation of current $I_{CS}$ by modulation unit 58 and that modulation unit 58 is capable of supplying a modulated current $I_{mod}$ to a terminal I_ctrl. Module 90 further comprises two terminals I_ctrl_in and I_ctrl_out and communication circuit 48 comprises a copying circuit 96 coupled to terminals I_ctrl_in and I_ctrl_out and coupled to demodulation unit 60 and capable of supplying a copy of the current flowing between terminals I_ctrl_in and I_ctrl_out to demodulation unit 60.

In the present embodiment, the transmission of data between the master module and the slave modules is achieved by a modulation of current $I_{mod}$ which is transmitted over a dedicated conductive line by the master module to the slave modules.

In optoelectronic circuit 95, the connection of terminals A, K, Vdd, and Gnd of each module 90 is identical to what has been previously described for module 40 in relation with FIG. 5, with the difference that the master module is preferably placed in the last position, that is, connected to node $A_2$. Further, terminal I_ctrl of the master module is coupled to terminal I_ctrl_in of the master module and terminal I_ctrl_out of the master module is coupled to terminal I_ctrl_in of the previous slave module in the succession of modules. For each slave module, terminal I_ctrl is not used. It is left floating or set to a neutral potential adequate for the circuit operation. Terminal I_ctrl_in is coupled to terminal I_ctrl_out of the next module in the succession of modules and terminal I_ctrl_out is coupled to terminal I_ctrl_in of the previous module in the succession of modules, except for the slave module in the first position having its terminal I_ctrl_out coupled to node A1 or Vdd via a resistor.

Optoelectronic circuit 95 operates as follows. The determination of the master module or of slave module role is performed as previously described for optoelectronic circuit 80. In operation, the modulation circuit 58 of the master module, under control of selection unit 51, modulates current $I_{mod}$ to transmit data by modulation of current $I_{mod}$. The modulation of current $I_{mod}$ may be of any type, for example, an amplitude modulation and/or a frequency modulation. The modulation circuit 58 of each slave module remains inactive. Current $I_{mod}$ flows from module to module by crossing the copying circuit 96 of each module 90. The copying circuit 96 of each module 90 supplies a copy of current $I_{mod}$ to demodulation unit 60. The demodulation unit 60 of each module is capable of receiving the data transmitted by demodulation of current $I_{mod}$ and switch control circuit 62 is capable of controlling switch 64 to the off or on state according to the received data.

An advantage of the present embodiment is that the modulation of current $I_{mod}$ by the modulation unit 58 of the master module can be implemented more simply than the modulation of current $I_{CS}$ in the embodiment previously described in relation with FIGS. 4 and 5. Indeed, the impedance seen by current source 42 due to the general light-emitting diodes of the module assembly is higher than the impedance seen by modulation unit 58 due to copying circuits 96. Further, the modulation does not affect the emitted light.

Figure 8:
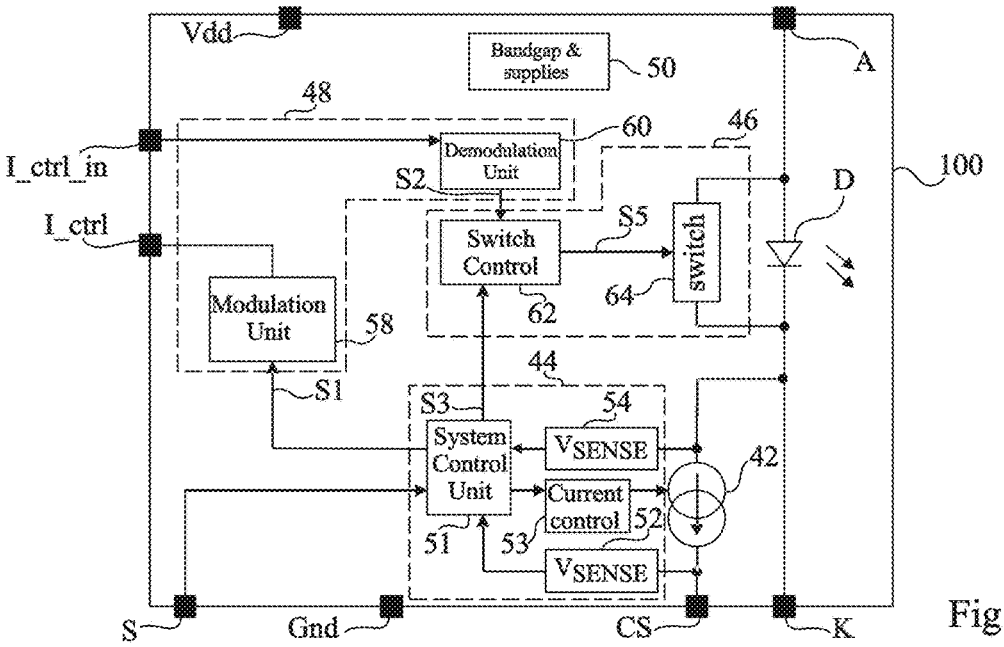
FIGS. 8 and 9 are drawings respectively similar to FIGS. 4 and 5 of another embodiment of a module and of an optoelectronic circuit formed from this module.
Figure 9:
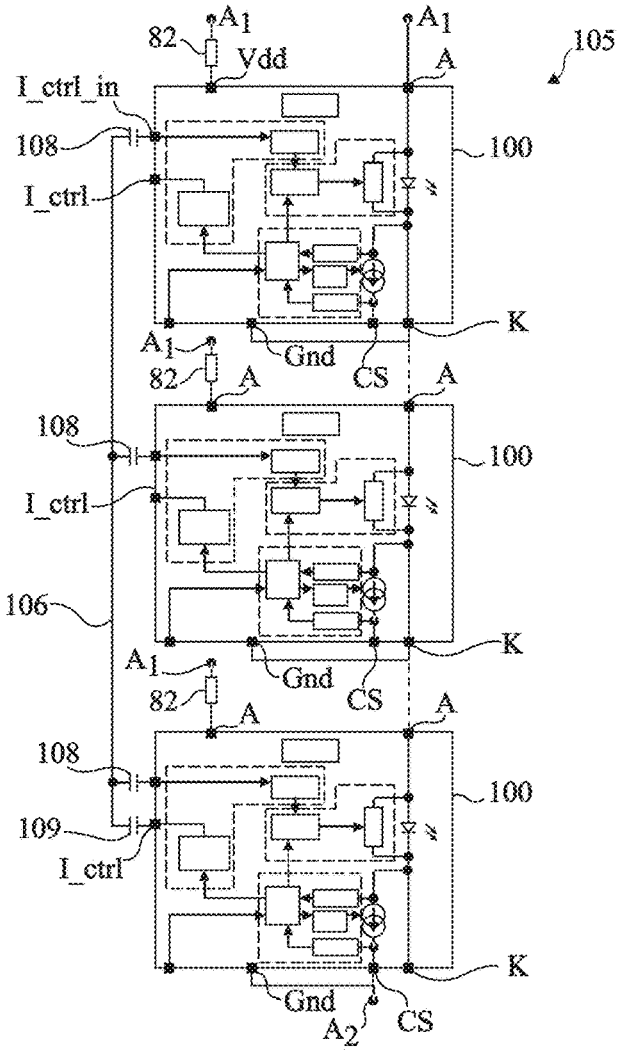

FIGS. 8 and 9 are drawings similar to FIGS. 4 and 5 respectively of another embodiment of a module 100 and of an optoelectronic circuit 105 comprising a plurality of modules 100.

The elements common between module 100 and module 90 are designated with the same references. Module 100 comprises all the elements of module 90, with the difference that terminal I_ctrl_out is not present and that terminal I_ctrl_in is directly coupled to demodulation unit 60.

In the present embodiment, the data transmission between the master module and the slave modules is performed by high-frequency modulation of the potential at terminal I_ctrl.

The connection of terminals A, K, Vdd, and Gnd of each module 100 is identical to what has been previously described for module 40 in relation with FIG. 5. Further, for each slave module, terminal I_ctrl is left floating. For each module, terminal I_ctrl_in is coupled to a conductive line 106 by a capacitor 108. Further, terminal I_ctrl of the master module is coupled to conductive line 106 by a capacitor 109.

Optoelectronic circuit 105 operates as follows. The determination of the master module or slave module role is performed as previously described for optoelectronic circuit 80. In operation, the modulation unit 58 of the master module, under control of selection unit 51, varies the potential at terminal I_ctrl to transmit data to the slave modules. The variations of the potential at terminal I_ctrl are reproduced at terminals I_ctrl_in of each slave module by capacitive coupling. The modulation of the potential at terminal I_ctrl may be of any type, for example, an amplitude modulation and/or a frequency modulation. The modulation circuit 58 of each slave module remains inactive.

The demodulation unit 60 of each module is capable of receiving the data transmitted to terminal I_ctrl_in and switch control unit 62 is capable of controlling switch 64 to the off or on state according to the received data.

According to an embodiment, each control circuit 46 is further capable of modulating the potential at terminal I_ctrl_in. A bidirectional communication can then be implemented between the master module and the slave modules. The provision of signal S3 of control circuit 44 to control circuit 46 enables to ease the establishing of a bidirectional communication protocol between the master module and the slave modules, particularly regarding priorities of access to the communication channel. An advantage of the present embodiment is that the transmission of data between modules is performed by capacitive coupling and thus enables to implement a bidirectional communication between the master module and each slave module having a performance which does not depend on the relative position in the succession of modules between the master module and the slave module.

Advantageously, it is not necessary to previously store in a memory of the master module the number of modules forming optoelectronic circuit 105. Indeed, each slave module may make itself known to the master module, for example, at the starting of optoelectronic circuit 105, the sequence of activation of the light-emitting diodes then being adapted by the master module according to the number of slave modules. This enables to simply modify the number of modules of optoelectronic circuit 105.

In the present embodiment, the data exchange between the master module and each slave module is performed over a single-wire link. According to another embodiment, the data transmission from the master module to each slave module is performed by using a twin-wire link, for example corresponding to an $I^2C$ bus or other.

Figure 10:
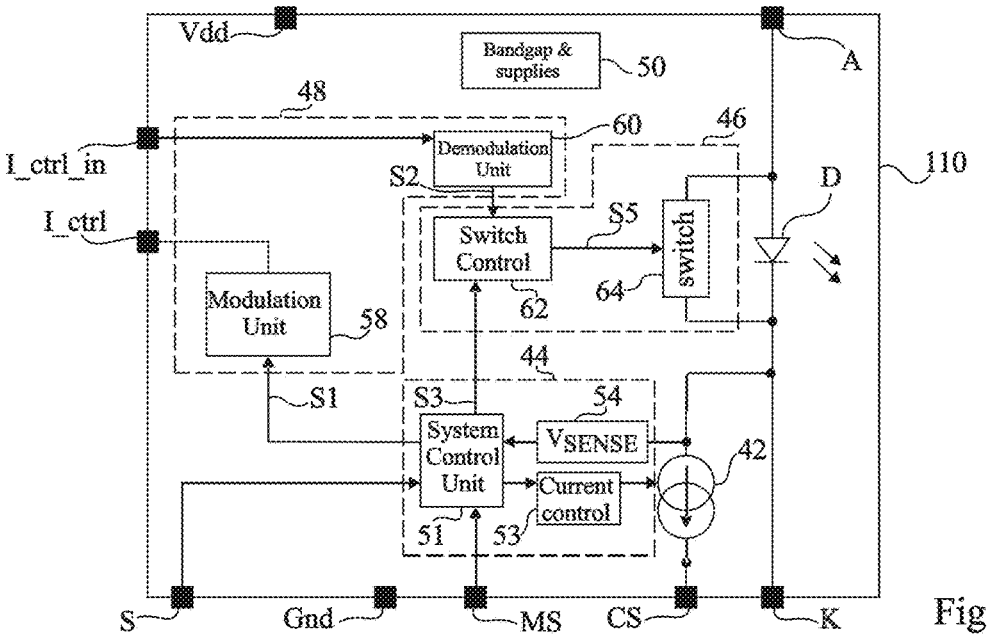
FIGS. 10 and 11 are drawings respectively similar to FIGS. 4 and 5 of another embodiment of a module and of an optoelectronic circuit formed from this module.
Figure 11:
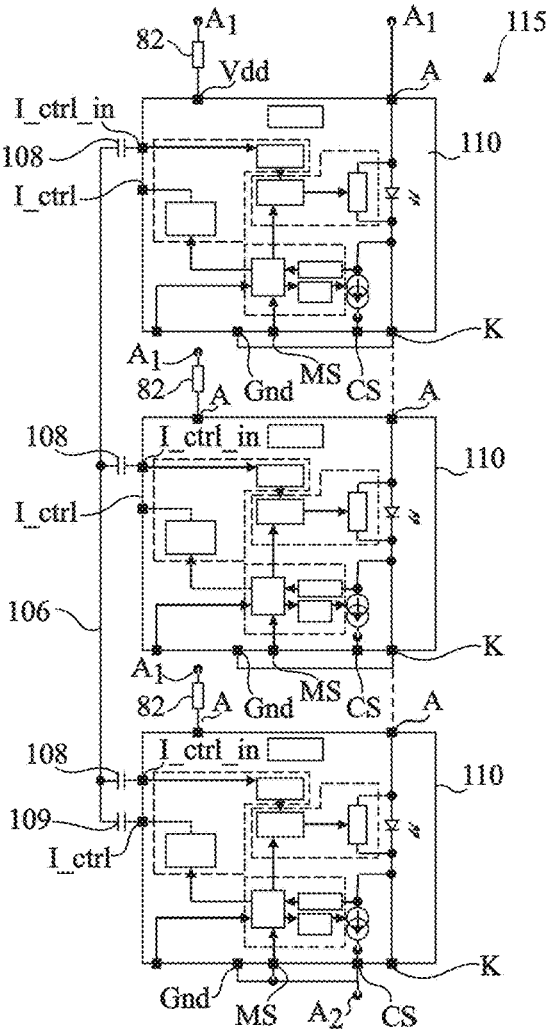

FIGS. 10 and 11 are drawings similar to FIGS. 8 and 9 respectively of another embodiment of a module 110 and of an optoelectronic circuit 115 comprising a plurality of modules 110.

The elements common between module 110 and module 100 are designated with the same references. Module 110 comprises all the elements of module 100, with the difference that module 110 comprises an additional terminal MS and that selection unit 51 of module 110 is connected to terminal MS instead of being connected to terminal CS as is the case for module 100.

In the present embodiment, the data transmission between the master module and the slave modules may be performed as previously described for module 100. As a variation, the data transmission between the master module and the slave modules may be implemented as described for module 40 or module 90.

The connection of terminals A, K, CS, K, Vdd, and Gnd of each module 110 is identical to what has been previously described for module 40 in relation with FIG. 5. Further, for each slave module, terminal MS is left floating. For the master module, terminal MS is coupled to terminal CS.

The selection unit 51 of each module 40 determines whether terminal MS is left floating or at a neutral potential different from GND. If this is true, selection unit 51 transmits an inhibition signal S3 to control circuit 46 and the considered module operates as a slave module. When terminal MS is detected as not being left floating, selection unit 51 transmits an activation signal S3 to control circuit 46 and the considered module operates as a master module.

Figure 12:
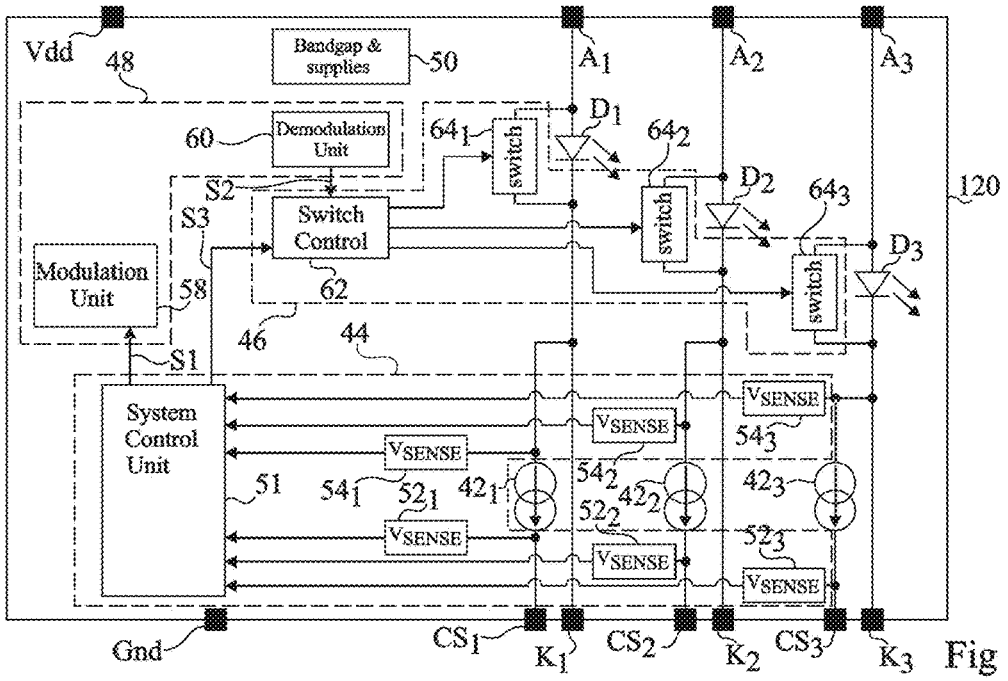
FIG. 12 is a drawing similar to FIG. 4 of another embodiment of a module of an optoelectronic circuit comprising light-emitting diodes.

FIG. 12 is a drawing similar to FIG. 4 of another embodiment of a module 120 comprising light-emitting diodes.

Module 120 has the same structure as module 40, with the difference that certain elements are present three times. In FIG. 12, index "1", "2", and "3" has been added to a reference designating an element of module 40 to designate each occurrence of this element in module 120. The current control circuits coupling circuit 51 to each current source $\mathbf{42}_1$, $\mathbf{42}_2$, and $\mathbf{42}_3$ have not been shown in FIG. 12.

In the present embodiment, module 120 comprises three general light-emitting diodes $D_1$, $D_2$ and $D_3$. Light-emitting diodes $D_1$, $D_2$, and $D_3$ may be capable of emitting light rays at different wavelengths, for example, respectively in Red, Green, and Blue. Switch control unit 62 is capable of separately controlling each switch $\mathbf{64}_1$, $\mathbf{64}_2$ and $\mathbf{64}_3$. Selection unit 51 receives the signals supplied by sensors $\mathbf{52}_1$, $\mathbf{52}_2$ and $\mathbf{52}_3$ and the signals supplied by sensors $\mathbf{54}_1$, $\mathbf{54}_2$ and $\mathbf{54}_3$.

In FIG. 12, the elements taking part in the data transmission from the master module to the slave modules are not shown. These elements may correspond to those of any of the embodiments previously described for modules 10, 40, or 90.

According to an embodiment, the rules of connection of modules 120 to one another are the same as those previously described for terminals A, CS, and K, separately considering the set of terminals $A_1$, $CS_1$, and $K_1$, the set of terminals $A_2$, $CS_2$, and $K_2$, and the set of terminals $A_3$, $CS_3$, and $K_3$, each set being referenced to the associated terminal Gnd. The general light-emitting diodes $D_1$ of modules 120 are then series-assembled, the general light-emitting diodes $D_2$ are series-assembled, and the general light-emitting diodes $D_3$ are series-assembled. The structure of module 120 advantageously enables to connect modules 120 in such a way that a first module plays the role of a master module for light-emitting diodes $D_1$, that a second module, possibly different from the first module, plays the role of a master module for light-emitting diodes $D_2$, and that a third module, possibly different from the first module and from the second module, plays the role of a master module for light-emitting diodes $D_3$. As a variation, only sensor $\mathbf{52}_1$ is present. In this case, the three sets of terminals $A_1$, $CS_1$, and $K_1$, $A_2$, $K_2$, and $CS_2$ and $A_3$, $CS_3$, and $K_3$ are connected in the same way so that the same module plays the role of a master module for light-emitting diodes $D_1$, $D_2$ and $D_3$.

In the present embodiment, the structure of module 120 derives from that of module 40, certain elements being present three times. As a variation, the structure of module 120 may be derived from module 110 shown in FIG. 10.

Figure 13:
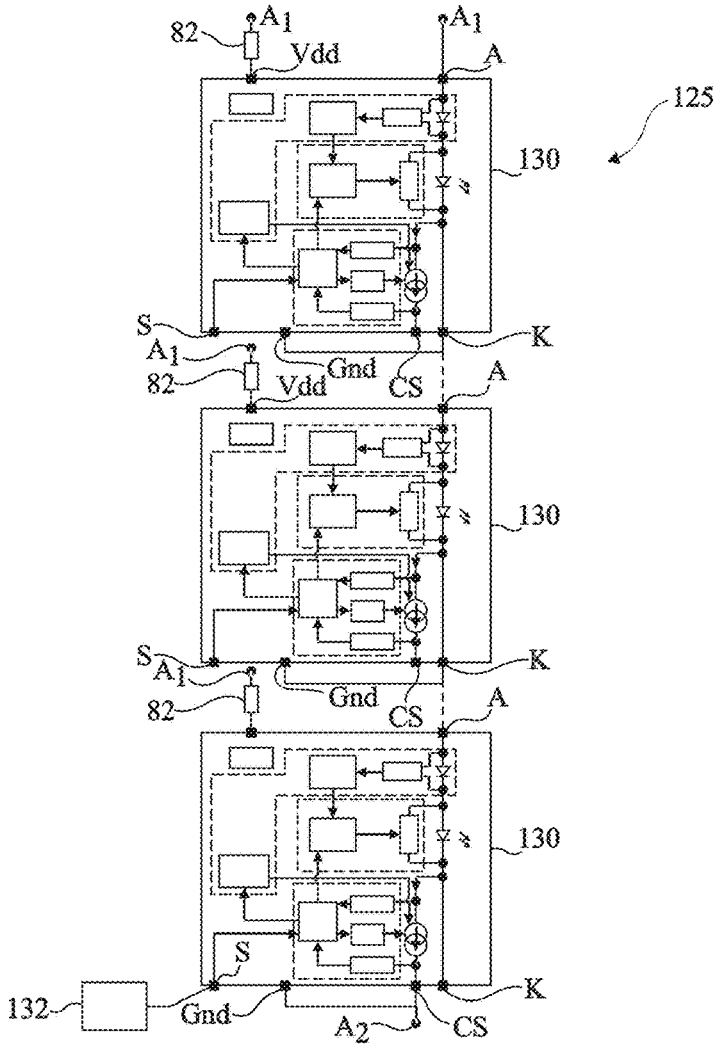
FIGS. 13 and 14 are electric diagrams of other embodiments of optoelectronic circuits comprising light-emitting diodes.

FIG. 13 shows an embodiment of an optoelectronic circuit 125 comprising a succession of series-assembled modules 130. In the present embodiment, a circuit 132, external to the modules, is coupled to terminal S of the master module. According to an embodiment, circuit 132 may comprise a sensor, for example, a luminosity sensor, or may comprise a dimmer, and the current set point $I_{CS}$ supplied by circuit 51 may depend on a signal supplied at terminal S by sensor 132. According to another embodiment, circuit 132 may be integrated to each module 130. According to another embodiment, circuit 132 may comprise an interface that can be actuated by a user and the activation sequence supplied by the control circuit 44 of the master module may then depend on the signal supplied by circuit 132. According to an embodiment, in the case where a bidirectional communication is established between the master module and the slave modules, circuit 132 may be connected to one of the slave modules and the signals supplied by circuit 132 to the slave module are transmitted back by the slave module to the master module. As a variation, each module 130 may have a structure similar to that of one of modules 90, 100, or 110.

Figure 14:
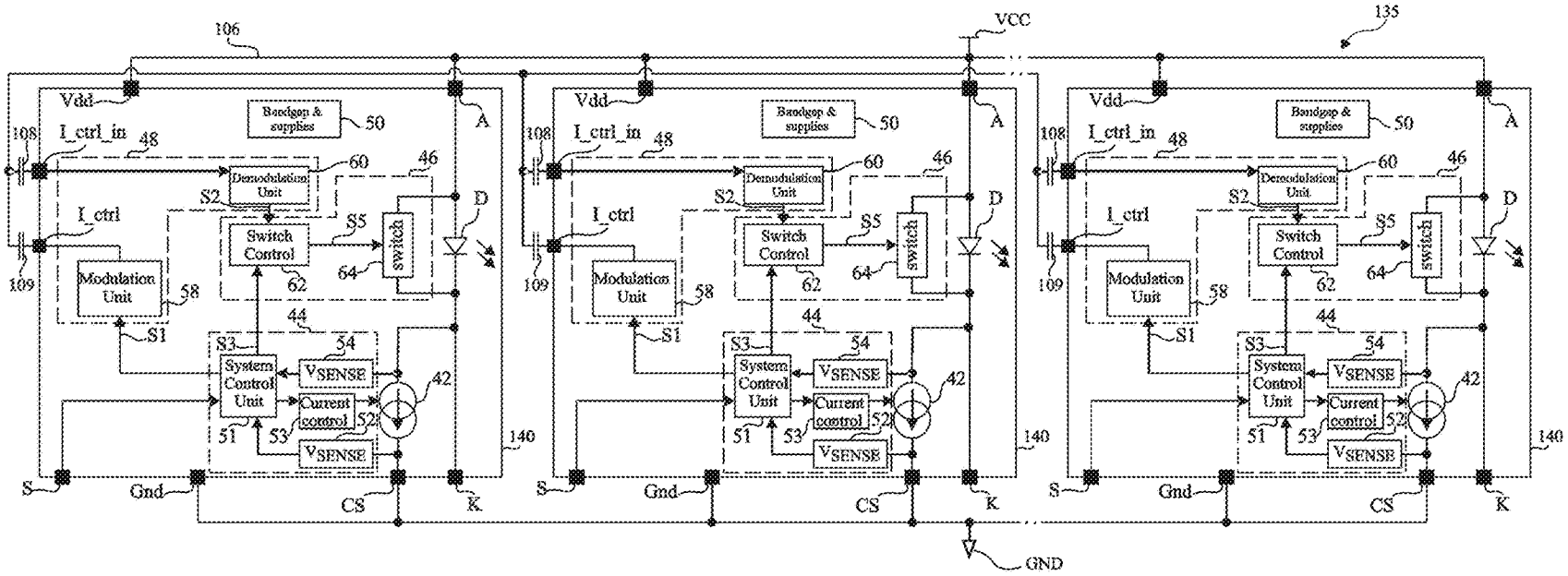

FIG. 14 shows an embodiment of an optoelectronic circuit 135 comprising a succession of modules 140 assembled in parallel. Each module 140 may comprise all the elements of module 100 previously described in relation with FIG. 8.

The terminals Vdd and A of each module 140 are coupled to a source of a high reference potential VCC. Terminals Gnd and CS are coupled to a low reference potential.

Each module 140 is assembled as a master module. Each module 140 is then capable of controlling its own light-emitting diode D. The data exchange between modules 140 may be performed as previously described for optoelectronic circuit 105 shown in FIG. 9. Since each module is a master module, for each module, terminal I_ctrl_in is coupled to conductive line 106 by capacitor 108 and terminal I_ctrl is coupled to conductive line 106 by capacitor 109.

As previously described, the data exchange between modules may, as a variation, be carried out over a twin-wire link, for example corresponding to an $I^2C$ bus or other.

According to an embodiment, the light-emitting diodes D of modules 140 are capable of emitting light at different wavelengths. As an example, optoelectronic circuit 135 comprises three modules 140. The light-emitting diodes D of these modules 140 may be capable of emitting light rays at different wavelengths, for example, respectively in Red, Green, and Blue. The assembly of modules 140 may then correspond to a display pixel.

Each module 140 is for example capable of modifying the light intensity emitted by the light-emitting diode D that it contains according to data supplied by at least one of the other modules 140. The modification of the light intensity may be performed by any type of modulation, for example, by an all-or-nothing modulation of the switch of activation/inhibition of light-emitting diode D or by a modulation of the intensity of the current supplied by current source 42. According to an embodiment, one of modules 140 is capable of receiving a set point of a property of the radiation emitted by optoelectronic circuit 135, for example, a color set point. The module 140 receiving the set point transmits data to the other modules 140 so that the property of the radiation emitted by all the light-emitting diodes follows this set point. This advantageously enables to transmit a general set point to the electronic circuit while the regulation of the radiation emitted by each module 140 is directly performed by the considered module 140.

Advantageously, in the previously-described embodiments, in particular when the number of elementary light-emitting diodes forming general light-emitting diode D is small, preferably smaller than 10, or even equal to 1, the electronic components used to form module 40, 90, 100, 120, 140 may be components adapted to low-voltage applications. This particularly enables to decrease the manufacturing cost of the module.

Specific embodiments have been described. Various alterations and modifications will occur to those skilled in the art. In particular, in the previously-described embodiments, the signal S4 from which the selection unit 51 of the master module supplies the sequence of activation/inhibition of the general light-emitting diodes of the modules corresponds to the potential at the cathode of general light-emitting diode D. However, circuit 51 may be controlled by another signal, for example, the potential at the anode of light-emitting diode D.

The invention claimed is:

1. An optoelectronic circuit comprising interconnected separate elementary electronic circuits, each elementary electronic circuit comprising:

at least one light-emitting diode; and at least one integrated circuit chip comprising:

a circuit for controlling the light-emitting diode capable of activating or of deactivating the light-emitting diode;

a communication circuit containing a modulation circuit capable of supplying a first modulated signal;

a demodulation circuit capable of supplying a second signal by demodulation of the first signal; and wherein the circuit for controlling the light-emitting diode is capable of activating or of inhibiting the light-emitting diode from the second signal.

2. The optoelectronic circuit of claim 1, wherein each elementary electronic circuit comprises in a same package said at least one light-emitting diode and said at least one integrated circuit chip.

3. The optoelectronic circuit of claim 1, wherein each elementary electronic circuit comprises a control circuit capable of supplying an activation or deactivation signal to the other elementary electronic circuits, wherein the optoelectronic circuit is intended to receive a variable voltage and wherein, for each elementary electronic circuit, the circuit for controlling the light-emitting diode is capable of activating or inhibiting the light-emitting diode according to the activation or deactivation signal, whereby the number of activated light-emitting diodes depends on the value of the variable voltage.

4. The optoelectronic circuit of claim 1, wherein each elementary electronic circuit comprises a current source coupled to the light-emitting diode.

5. The optoelectronic circuit of claim 1, wherein the integrated circuit chip of each elementary electronic circuit further comprises a circuit for detecting a master or slave state of the elementary electronic circuit when the elementary electronic circuit is in operation.

6. The optoelectronic circuit of claim 1, comprising a plurality of series-assembled elementary electronic circuits.

7. The optoelectronic circuit of claim 1, wherein at least one of the elementary electronic circuits, called master circuit, is capable of transmitting data to the other elementary electronic circuits, called slave circuits, so that the light-emitting diodes are activated randomly or according to a given succession.

8. The optoelectronic circuit of claim 7, wherein each elementary electronic circuit further comprises a first terminal, wherein the optoelectronic circuit comprises a sensor coupled to the first terminal of one of the elementary electronic circuits, and wherein the intensity of the current supplied by the current source of the master circuit depends on a third signal supplied by the sensor.

9. The optoelectronic circuit of claim 1, comprising a plurality of elementary electronic circuits assembled in parallel.

10. The optoelectronic circuit of claim 1, wherein, for each elementary electronic circuit, the first signal corresponds to a modulation of the power supply current of the light-emitting diode.

11. The optoelectronic circuit of claim 1, wherein each elementary electronic circuit further comprises a second terminal, and wherein the second signal corresponds to a modulated current supplied by the modulation circuit to the second terminal, which is different from the light-emitting diode power supply current or wherein the second signal corresponds to the potential at said terminal.

12. The optoelectronic circuit of claim 11, further comprising a third terminal, the demodulation circuit being capable of receiving the second signal via the third terminal.

13. The optoelectronic circuit of claim 12, wherein the third terminal of each elementary electronic circuit is coupled to a conductive line via a capacitor.

14. The optoelectronic circuit of claim 12, wherein each elementary electronic circuit further comprises a fourth terminal and a copying circuit coupling the third terminal and the fourth terminal and capable of supplying the demodulation circuit with a copy of the current flowing between the third and fourth terminals.

15. The optoelectronic circuit of claim 14, wherein the elementary electronic circuits are series-assembled according to a succession of elementary electronic circuits and wherein, for each elementary electronic circuit, except for the elementary electronic circuits located at the ends of the succession, the fourth terminal of the elementary electronic circuit is coupled to the third terminal of the previous elementary electronic circuit in the succession.

16. The optoelectronic circuit of claim 1, wherein each elementary electronic circuit comprises less than five light-emitting diodes.

* * * * *